US011242632B1

(12) United States Patent
Zeru

(10) Patent No.: US 11,242,632 B1
(45) Date of Patent: Feb. 8, 2022

(54) AUTOMATIC LAUNDRY MACHINE

(71) Applicant: Eyob T. Zeru, Seattle, WA (US)

(72) Inventor: Eyob T. Zeru, Seattle, WA (US)

( * ) Notice: Subject to any disclaimer, the term of this patent is extended or adjusted under 35 U.S.C. 154(b) by 83 days.

(21) Appl. No.: 16/689,412

(22) Filed: Nov. 20, 2019

Related U.S. Application Data

(60) Provisional application No. 62/770,419, filed on Nov. 21, 2018.

(51) Int. Cl.

| | |
|---|---|
| ***D06F 29/00*** | (2006.01) |
| ***D06F 39/12*** | (2006.01) |
| ***D06F 33/00*** | (2020.01) |
| ***D06F 34/18*** | (2020.01) |
| ***D06F 34/28*** | (2020.01) |

(52) U.S. Cl.
CPC ..... *D06F 29/005* (2013.01); *D06F 33/00* (2013.01); *D06F 34/18* (2020.02); *D06F 34/28* (2020.02); *D06F 39/12* (2013.01)

(58) Field of Classification Search
None
See application file for complete search history.

(56) References Cited

U.S. PATENT DOCUMENTS 6,671,978 B1 1/2004 McGowan et al.
7,404,303 B1 * 7/2008 Barbosa ..... D06F 37/10 68/3 R
8,813,287 B2 8/2014 Saubert
9,499,931 B2 11/2016 Ham et al.
9,506,183 B2 11/2016 Del Pos et al.
9,617,675 B2 4/2017 Saubert
2004/0025368 A1 * 2/2004 Gerlach ..... D06F 35/00 34/418
2007/0169519 A1 7/2007 Hershey et al.
2008/0236208 A1 * 10/2008 Miyata ..... D06F 35/001 68/5 C
2011/0016928 A1 * 1/2011 Beihoff ..... D06F 58/203 68/19
2011/0030148 A1 2/2011 Saubert
2014/0059881 A1 * 3/2014 Kim ..... D06F 39/02 34/493
2014/0326024 A1 11/2014 Saubert
2015/0047128 A1 * 2/2015 Goshgarian ..... D06F 34/18 8/137
2016/0218884 A1 * 7/2016 Ebrom ..... H04L 12/2814

* cited by examiner

*Primary Examiner* — Cristi J Tate-Sims
(74) *Attorney, Agent, or Firm* — Cramer Patent & Design, PLLC; Aaron R. Cramer

(57) ABSTRACT

An automatic laundry machine is fashioned as a device having a washing machine and dryer in a single unit, a plurality of washing soap and fabric softener reservoirs, a means for calibrating the weight of a load of wash and automatically dispensing a corresponding amount of washing soap and fabric softener and a mechanical conveyor capable of moving washed clothing from the washing machine component to the drying component. Each component is capable of independent operation.

14 Claims, 3 Drawing Sheets

AUTOMATIC LAUNDRY MACHINE

RELATED APPLICATIONS

The present invention was first described in and claims the benefit of U.S. Provisional Application No. 62/770,419 filed Nov. 21, 2018, the entire disclosures of which are incorporated herein by reference.

FIELD OF THE INVENTION

The present invention relates generally to an automatic laundry machine and more specifically to an automatic laundry machine having a washing machine and dryer in a single unit.

BACKGROUND OF THE INVENTION

All of us know of the hassles and burdens associated with doing laundry. One must constantly monitor the washing machine and dryer, transferring clothes from one (1) to the other in order complete the process. In doing so, the user is somewhat trapped in the sense that the process cannot be left unattended and is forced to stay nearby while the washer or dryer is in operation. It is another common problem in that a load of wash cannot be started because it will sit wet in the washer for hours after the washing cycle is complete, whereupon wrinkles and odors may result. Thus, the time to wash and dry clothes has to be long enough, but the person must also be available in between cycles to move clothes as well. All of these restraints just add to the drudgery of laundry. Accordingly, there is a need for a washer/dryer that eliminates the need for constant human intervention to transfer wet items from the washer to the dryer. The development of the combination washer/dryer with automated interface fulfills this need.

SUMMARY OF THE INVENTION

In view of the foregoing disadvantages inherent in the prior art, it has been observed that there is need for a combination washer/dryer with automated interface, comprises an outer enclosure which has an upper portion and a lower portion and a clothes washing section which is incorporated into the upper portion. The clothes washing section has a washer access door that receives a plurality of clothes that are inserted and removed through the washer access door. The combination washer/dryer with automated interface also comprises a clothes drying section which is incorporated into the lower portion. The lower portion has a dryer access door that receives the clothes that are inserted and removed through the dryer access door. The combination washer/dryer with automated interface also comprises a cold-water connection, a warm water connection, a drain line, an optional gas line, a dryer vent line, and an electrical power connection provided to operate the clothes washing section and the clothes drying section.

The combination washer/dryer with automated interface also comprises a washer control panel controlling the clothes washing section. The washer control panel is provided on the face of the combination washer/dryer with automated interface. The combination washer/dryer with automated interface also comprises a dryer control panel controlling the clothes drying section. The dryer control panel is provided on the face of the combination washer/dryer with automated interface. The combination washer/dryer with automated interface also comprises an interior washing drum sitting superjacent to an interior drying drum as the clothes are placed through the washer access door and into the washing drum, a plurality of weight sensors calculating the total weight of the clothes placed in the washing drum and a plurality of cleaning aids stored in a plurality of cleaning aid reservoirs above the washing drum.

The outer enclosure may be made of steel while the washer access door may be a first push-to-open/push-to-close style door. The dryer access door may be a second push-to-open/push-to-close style door. The total weight of the clothes may have a pre-determined weight limit. The weight limit exceeded as sensed by the weight sensors indication provided on the washer control panel may prompt removal of the clothes until passing below the pre-determined weight limit.

A clothing type may be selected on the washing drum. The clothing type may be selected from the group consisting of whites, darks, mixed, cottons, synthetics, delicates, or durables. The combination washer/dryer with automated interface may automatically select one or more cleaning parameters. The one or more cleaning parameters may include water temperature, washing time, and rinsing time. The one or more cleaning parameters may be overridden via the washer control panel. The cleaning aids are a cleaning material which may be selected from the group consisting of a soap, a softener, a stain remover, and a whitener. The release of the cleaning aids may be controlled via the washer control panel at a time and a quantity by a set of cleaning aid feeder measuring valves. The cleaning aids contained within the cleaning aid reservoirs may be liquid or powdered.

The drying drum may be provided with a refresher reservoir that dispenses refresher into the drying drum into the drying drum as controlled by the dryer control panel. The drying drum may be facilitated by a refresher feeder measuring valve. The combination washer/dryer with automated interface may also comprise a plurality of washer drum transfer panels provided on the perimeter of the washing drum are pivoted downward by a plurality of washer panel servo drives a plurality of dryer drum transfer panels provided on the perimeter of the drying drum are pivoted downward by a plurality of dryer panel servo drives.

The washer drum transfer panels and the dryer drum transfer panels may allow for wet clothes that have completed their washing cycle to transfer via gravity into the drying drum in an automatic manner when the washing drum and the drying drum are placed in position. The dryer panel servo drives open the dryer drum transfer panels and the washer panel servo drives open the washer drum transfer panels and the clothes would transfer without human aid.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
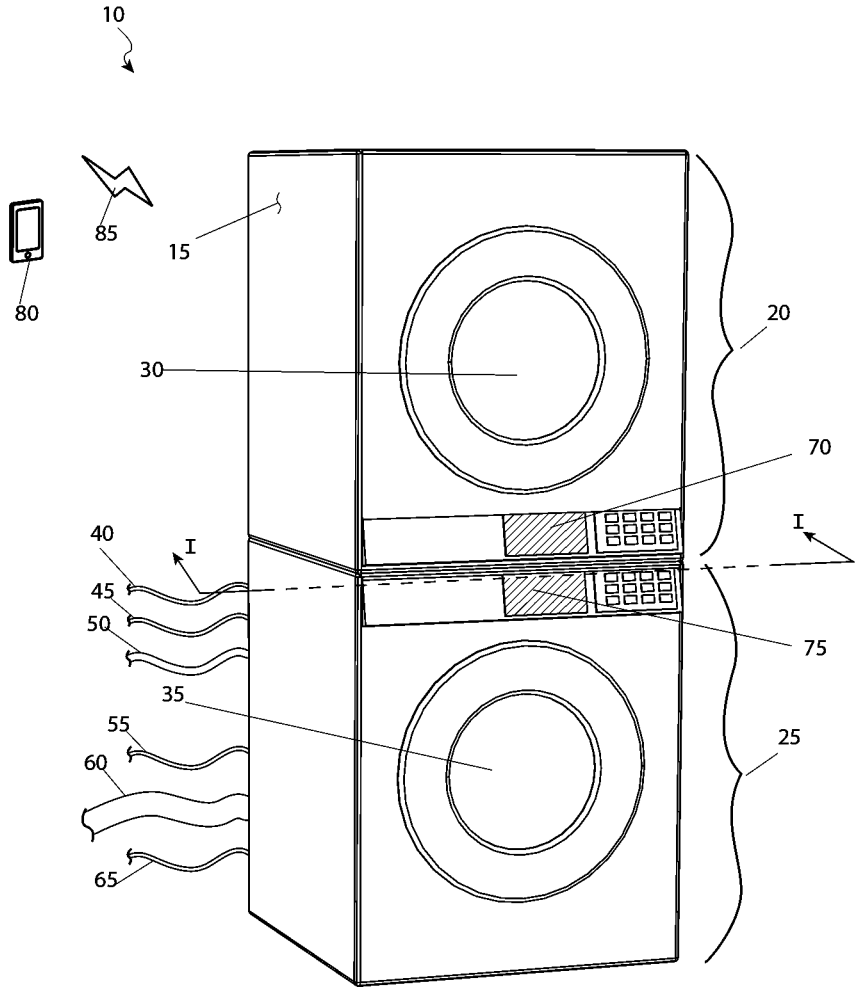
FIG. 1 is a perspective view of the combination washer/dryer with automated interface 10, according to the preferred embodiment of the present invention.

10 combination washer/dryer with automated interface
15 outer enclosure
20 clothes washing section
25 clothes drying section
30 washer access door
35 dryer access door
40 cold water connection
45 warm water connection
50 drain line
55 optional gas line
60 dryer vent line
65 electrical power connection
70 washer control panel
75 dryer control panel
80 personal electronic device
85 radio frequency (RF) link
90 washing drum
95 drying drum
100 weight sensor
102 cleaning aid
105 cleaning aid reservoir
110 cleaning aid feeder measuring valve
112 refresher
115 refresher reservoir
120 refresher feeder measuring valve
125 washer drum transfer panel
130 washer panel servo drive
135 dryer drum transfer panel
140 dryer panel servo drive
145 power supply
150 washer control computer
155 dryer control computer
160 wireless communication module
165 conventional washer control
170 conventional dyer control 1. Description of the Preferred Embodiment The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the combination washer/dryer with automated interface 10, according to the preferred embodiment of the present invention is disclosed. The combination washer/dryer with automated interface 10 (herein also described as the "device") 10, is fashioned as an otherwise standard "stacked" washer/dryer combination with an outer enclosure 15 envisioned to be made of sheet steel. The upper portion incorporates a clothes washing section 20, while the lower portion incorporates a clothes drying section 25. Dirty clothes that are to be washed are inserted through a washer access door 30 and clothes that are clean and dry are removed through a dryer access door 35. Various utilities such as washer access door 30, a dryer access door 35, a cold water connection 40, a warm water connection 45, a drain line 50, an optional gas line 55, a dryer vent line 60, and an electrical power connection 65 are provided as are customarily expected. A washer control panel 70 used to control various operating parameters of the clothes washing section 20 is provided on the face of the device 10. A dryer control panel 75 used to control various operating parameters of the clothes drying section 25 is provided on the face of the device 10. The washer access door 30 and the dryer access door 35 are each preferably a push-to-open/push-to-close style. Operating status of the device 10 may be monitored remotely on a personal electronic device (such as a smart phone) 80 via use of a radio frequency (RF) link 85 including, but not limited to: Wi-Fi, cellular data connection, Bluetooth®, or the like.

Figure 2:
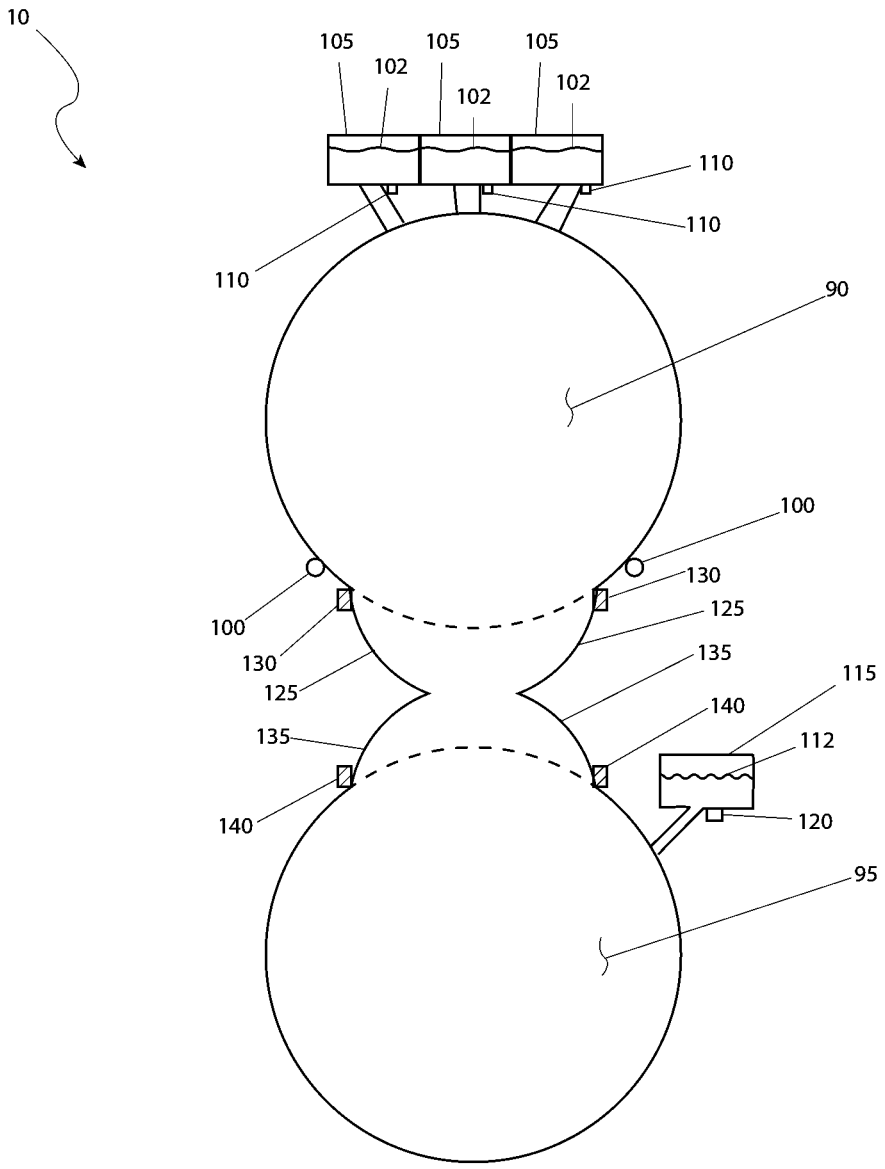
FIG. 2 is a sectional view of the combination washer/dryer with automated interface 10, as seen along a line I-I, as shown in FIG. 1, according to the preferred embodiment of the present invention; and, FIG. 3 is an electrical block diagram of the combination washer/dryer with automated interface 10, according to the preferred embodiment of the present invention.

Referring next to FIG. 2, a sectional view of the device 10, as seen along a line I-I, as shown in FIG. 1, according to the preferred embodiment of the present invention is depicted. This figure discloses an interior washing drum 90 sitting superjacent to an interior drying drum 95. As clothes are placed through the washer access door 30 (as shown in FIG. 1) and into the washing drum 90, a plurality of weight sensors 100 calculate the total weight of items placed in the washing drum 90. A pre-determined weight limit is present. Should the weight limit be exceeded as sensed by the weight sensors 110, indication is provided on the washer control panel 70 (as shown in FIG. 1) thus prompting the removal of items until passing below the pre-determined weight limit. The user would next select the type of clothing inserted into the washing drum 90, such as whites, darks, mixed, and/or textile material such as cottons, synthetics, delicates, durables, or the like via the washer control panel 70. The device 10 would then automatically select cleaning parameters, such as water temperature, washing/rinsing times and the like. However, it is envisioned that the user may override the selection if desired, also via the washer control panel 70. A bulk quantity of multiple cleaning aids 102, including, but not limited to: soap, softener, stain remover, whitener and the like are stored in cleaning aid reservoirs 105 above the washing drum 90. Release of the cleaning aids 102 is controlled via the washer control panel 70 at the appropriate time and quantity by a set of cleaning aid feeder measuring valves 110. It is envisioned that the cleaning aids 102 contained within the cleaning aid reservoirs 105 could be of the liquid or powdered variety. In a similar manner, the drying drum 95 is provided with a refresher reservoir 115 that dispenses refresher 112 into the drying drum 95 at an appropriate time and quantity into the drying drum 95 as controlled by the dryer control panel 75. Such control is facilitated by a refresher feeder measuring valve 120.

A set of two (2) washer drum transfer panels 125 are provided on the perimeter of the washing drum 90. Their normal "in-use" position is depicted by dashed lines. They are pivoted downward by a set of two (2) washer panel servo drives 130 to a position as shown. In a likewise manner, a set of two (2) dryer drum transfer panels 135 are provided on the perimeter of the drying drum 95. Their normal "in-use" position is depicted by dashed lines. They are pivoted downward by two (2) dryer panel servo drives 140 to a position as shown. The functionality of the washer drum transfer panels 125 and the dryer drum transfer panels 135 allow for wet clothes that have completed their washing cycle to transfer via gravity into the drying drum 95 in an automatic manner. Both the washing drum 90 and the drying drum 95 would be keyed into position. The dryer panel servo drives 140 would open the dryer drum transfer panels 135. The washer panel servo drives 130 would open the washer drum transfer panels 125 and clothes would transfer without human aid. It is understood by those familiar in the art, that other functionality of the clothes washing section 20 and the clothes drying section 25 including, but not limited to: agitator action, pump action, timing cycles, dryness sensors, door lock controls, cool down cycles, moisture sensing and the like, commonly available on conventional washer/dryer combinations are also controlled via the washer control panel 70 and the dryer control panel 75.

Figure 3:
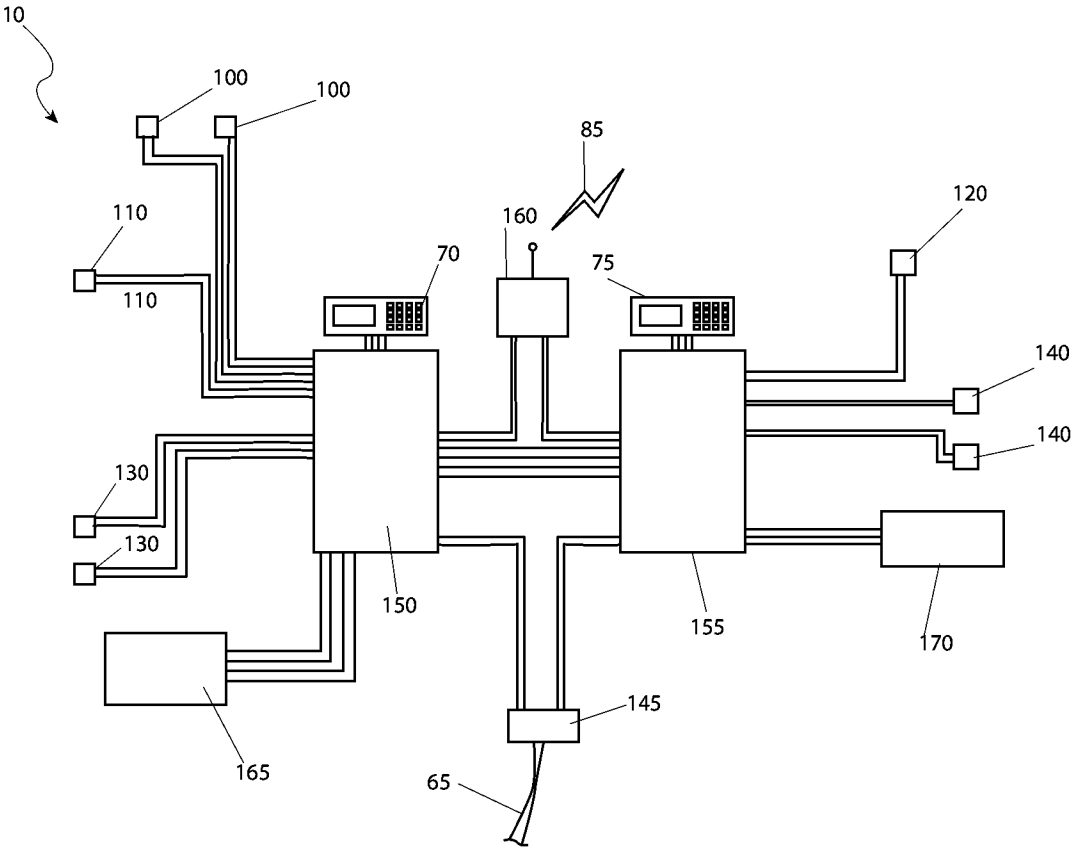

Referring to FIG. 3, an electrical block diagram of the device 10, according to the preferred embodiment of the present invention is shown. Incoming electrical power is delivered via the electrical power connection 65 to a power supply 145. Resultant power is then delivered to a washer control computer 150 and a dryer control computer 155 at the appropriate voltage and current levels. The washer control panel 70 is electrically connected to the washer control computer 150 while the dryer control panel 75 is connected to the dryer control computer 155. The washer control computer 150 and the dryer control computer 155 are connected to one (1) another as well as to a wireless communication module 160 which generates the radio frequency (RF) link 85 as described in FIG. 1. The washer control computer 150 is electrically connected to the weight sensors 100, the cleaning aid feeder measuring valve 110 and the washer panel servo drives 130, while the dryer control computer 155 is connected to the refresher feeder measuring valve 120 and the dryer panel servo drives 140. The washer control computer 150 is connected to the balance of the conventional washer controls 165 including but not limited to: cycle times, dirt sensors, dryness sensors, pumps, solenoid valves, and the like. Likewise, the dryer control computer 155 is connected to the balance of the conventional dyer controls 170 including, but not limited to: cycle times, wetness sensors, motors, contactors, solenoid valves, and the like.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 3. The user would procure the device 10 through normal procurement channels paying particular attention to fuel type (gas or electric for dryer), color, capacity and the like.

After procurement and prior to utilization, the device 10 would be prepared in the following manner: needed utility connections would be made via the cold water connection 40, the warm water connection 45, the drain line 50, the optional gas line 55 (if needed), the dryer vent line 60, and the electrical power connection 65; desired quantities of cleaning aids 102 would be placed in the cleaning aid reservoirs 105; various quantities of the refreshers 112 would be placed in the refresher reservoir 115; and noted types would be programmed via the washer control panel 70 and the dryer control panel 75, respectively.

During utilization of the device 10, the following procedure would be initiated: dirty clothing would be inserted through the washer access door 30 and into the washing drum 90; if weight limit is exceeded as detected by the weight sensors 100 and indicated by the washer control panel 70, clothing would be removed; type of clothing inserted (whites, coloreds, delicates, durables, etc.) would be programmed via the washer control panel 70; suggested cleaning processes could be accepted or overridden; and washing initiated by the washer control panel 70. At the completion of the washing cycle, both the washing drum 90 and the drying drum 95 would be keyed into position; the dryer panel servo drives 140 would open the dryer drum transfer panels 135; the washer panel servo drives 130 would open the washer drum transfer panels 125 and clothes would transfer without human aid; and drying cycle would automatically commence. At the completion of the drying cycle, indication would be provided via local annunciation as well as communicated to the smart phone 80 via the radio frequency (RF) link 85 to alert the user that the successfully cleaned and dried clothes could be removed from the drying drum 95 via the dryer access door 35. Power is cut off to the device 10 at the end of the drying cycle, but indication to the user commences at pre-determined intervals.

After use of the device 10, it is ready to use again in a cyclical manner as expected of conventional washer and dryers along with periodic replenishment of the cleaning aid reservoirs 105 and the refresher reservoir 115.

The automated functionality of transfer of clothing between the washing drum 90 and the drying drum 95 is envisioned to provide the following advantages over conventional separated washer/dryer combinations: when used in public laundry mats, it will allow for remote notification to the user that laundry is ready to be removed thus minimizing frustration to following customers, allow for attention to other tasks such as cleaning, eating, meal preparation, education and the like not normally possible due to attention that must be provided to transfer clothes manually, reduced opportunity to steal clothes due to door locking features while the device 10 is operating, and general increased efficiency.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A combination washer/dryer with automated interface, comprising:

an outer enclosure having an upper portion and a lower portion;

a clothes washing section incorporated into the upper portion, the clothes washing section having a washer access door that receives a plurality of clothes that are inserted and removed through the washer access door;

a clothes drying section incorporated into the lower portion, the lower portion having a dryer access door that receives the clothes that are inserted and removed through the dryer access door;

a cold-water connection, a warm water connection, a drain line, an optional gas line, a dryer vent line, and an electrical power connection provided to operate the clothes washing section and the clothes drying section;

a washer control panel controlling the clothes washing section, the washer control panel is provided on the face of the combination washer/dryer with automated interface;

a dryer control panel controlling the clothes drying section, the dryer control panel is provided on the face of the combination washer/dryer with automated interface;

an interior washing drum sitting superjacent to an interior drying drum as the clothes are placed through the washer access door and into the washing drum;

a plurality of weight sensors calculating the total weight of the clothes placed in the washing drum; and a plurality of cleaning aids stored in a plurality of cleaning aid reservoirs above the washing drum;

wherein the washer access door is a first push-to-open/push-to-close style door;

wherein the total weight of the clothes have a pre-determined weight limit;

wherein the weight limit exceeded as sensed by the weight sensors indication provided on the washer control panel prompts removal of the clothes until passing below the pre-determined weight limit;

wherein a clothing type is selected on the washing drum; and wherein the clothing type is selected from the group consisting of whites, darks, mixed, cottons, synthetics, delicates, or durables.

2. The combination washer/dryer with automated interface according to claim 1, wherein the outer enclosure is made of steel.

3. The combination washer/dryer with automated interface according to claim 1, wherein the combination washer/dryer with automated interface automatically selects one or more cleaning parameters.

4. The combination washer/dryer with automated interface according to claim 3, wherein the one or more cleaning parameters include water temperature, washing time, and rinsing time.

5. The combination washer/dryer with automated interface according to claim 3, wherein the one or more cleaning parameters are overridden via the washer control panel.

6. The combination washer/dryer with automated interface according to claim 1, wherein the cleaning aids are a cleaning material selected from the group consisting of a soap, a softener, a stain remover, and a whitener.

7. The combination washer/dryer with automated interface according to claim 1, wherein release of the cleaning aids are controlled via the washer control panel at a time and a quantity by a set of cleaning aid feeder measuring valves.

8. The combination washer/dryer with automated interface according to claim 1, wherein the cleaning aids contained within the cleaning aid reservoirs are liquid.

9. The combination washer/dryer with automated interface according to claim 1, wherein the cleaning aids contained within the cleaning aid reservoirs are powdered.

10. The combination washer/dryer with automated interface according to claim 1, wherein the drying drum is provided with a refresher reservoir that dispenses refresher into the drying drum into the drying drum as controlled by the dryer control panel.

11. The combination washer/dryer with automated interface according to claim 1, wherein the drying drum is facilitated by a refresher feeder measuring valve.

12. The combination washer/dryer with automated interface according to claim 1, further comprising a plurality of washer drum transfer panels provided on the perimeter of the washing drum are pivoted downward by a plurality of washer panel servo drives a plurality of dryer drum transfer panels provided on the perimeter of the drying drum are pivoted downward by a plurality of dryer panel servo drives.

13. The combination washer/dryer with automated interface according to claim 12, wherein the washer drum transfer panels and the dryer drum transfer panels allow for wet clothes that have completed their washing cycle to transfer via gravity into the drying drum in an automatic manner when the washing drum and the drying drum are placed in position.

14. The combination washer/dryer with automated interface according to claim 12, wherein the dryer panel servo drives open the dryer drum transfer panels and the washer panel servo drives open the washer drum transfer panels and the clothes would transfer without human aid.

* * * * *